United States Patent [19]

Lueptow et al.

[11] Patent Number: 4,482,342

[45] Date of Patent: Nov. 13, 1984

[54] BLOOD PROCESSING SYSTEM FOR CELL WASHING

[75] Inventors: Richard M. Lueptow, Allston; Jeffrey J. Peterson, Wellesley, both of Mass.

[73] Assignee: Haemonetics Corporation, Braintree, Mass.

[21] Appl. No.: 389,242

[22] Filed: Jun. 17, 1982

[51] Int. Cl.[3] ..... B04B 5/02

[52] U.S. Cl. ..... 494/21; 210/927; 383/121; 494/27; 494/37; 494/45; 604/410

[58] Field of Search ..... 494/16, 17, 18, 21, 494/27, 37, 20, 45; 604/410; 383/105, 121, 127; 219/927

[56] References Cited

U.S. PATENT DOCUMENTS

| | | |
|---|---|---|
| 2,815,025 | 12/1957 | Fenton et al. . |
| 2,855,933 | 10/1958 | Erikson . |
| 3,185,154 | 5/1965 | Caccavo et al. . |
| 3,520,471 | 7/1970 | Faust . |
| 3,748,101 | 7/1973 | Jones et al. . |
| 3,905,477 | 9/1975 | Graham . |
| 4,007,871 | 2/1977 | Jones et al. . |
| 4,010,894 | 3/1977 | Kellogg et al. . |
| 4,146,172 | 3/1979 | Cullis et al. . |
| 4,185,629 | 1/1980 | Cullis et al. . |
| 4,187,979 | 2/1980 | Cullis et al. . |
| 4,196,088 | 4/1980 | Bacehowski et al. . |
| 4,316,576 | 2/1982 | Cullis et al. . |
| 4,322,298 | 3/1982 | Persidsky . |

OTHER PUBLICATIONS

H. T. Meryman et al., "The Preparation of Leukocyte-Poor Red Blood Cells: A Comparative Study," *Transfusion* 20, No. 3: 285–292, May–Jun. 1980.

M. J. O'Connor Wooten, "Use and Analysis of Saline Washed Red Blood Cells," *Transfusion* 16, No. 5: 464–468, Sep.–Oct. 1976.

*Primary Examiner*—Robert W. Jenkins

*Attorney, Agent, or Firm*—Hamilton, Brook, Smith & Reynolds

[57] ABSTRACT

A cell washing method and apparatus which utilizes centrifugation to separate blood components in a flexible bag. The less dense separated components e.g., supernatant, is expressed from the bag by centrifugal force acting on a plate adjacent the bag and the more dense component e.g., RBC's, remains. The bag is oriented at a double angle in the centrifuge so that less dense component accumulates at one location and more dense at a second location diagonally opposite the first location, thus facilitating removal of the less dense and washing of the more dense component.

31 Claims, 9 Drawing Figures

*DESIRED*

*UNDESIRED*

BLOOD PROCESSING SYSTEM FOR CELL WASHING

DESCRIPTION

1. Technical Field This invention is in the field of fluid processing and more particularly relates to the centrifugal separation of fluid, such as blood, into two or more components, such as during cell washing or component separation.

2. Background Art It is often desirable to transfuse only the red blood cells to a transfusion recipient since red blood cells (RBC's) are not known to cause an immunological reaction in a recipient.

Present state of the art processes for initially separating donated whole blood into its component elements, such as RBC's, platelets and plasma proteins and white blood cells, are not sufficiently effective in entirely removing substantially all undesirable components from the RBC's.

It is therefore necessary to provide a system and procedure for "washing" the packed RBC's. (Note: The term "packed RBC's" will hereafter be used to refer to unwashed RBC's which have been separated from other whole blood components). The packed RBC's are washed with a wash solution, such as saline, to remove such undesirable components remaining after the initial centrifugal separation. Such undesirable components, unlike RBC's are known to cause adverse transfusion reactions.

The packed RBC's can be washed in a number of ways. One method now in practice is to centrifuge a unit of donor blood in a collection bag and subsequently remove the plasma and buffy coat manually using a plasma expressor leaving packed RBC's in the collection bag. Then the packed RBC's are diluted with saline, centrifuged again, and the supernatant manually removed using an expressor, leaving washed RBC's.

Packed RBC's can also be washed by diluting the packed RBC's with saline in a centrifugal processing bag or bowl and expressing the supernatant through a rotating seal leaving washed cells. The Haemonetics Model 102 cell washing equipment is of the bowl type. (See: *The Preparation of Leukocyte-Poor Red Blood Cells: A Comparative Study* Meryman et al., Transfusion 20(3):285:287,1980)

The IBM 2991 Cell Washer (generally described in U.S. Pat. Nos. 4,007,871 and 4,010,894) utilizes a spin and agitation method in which packed RBC's are spun within a saline solution in a toroidal chamber of fixed volume and then agitated in the chamber. This process is repeated many times with fresh wash solution until sufficient hematocrit of the washed RBC's is attained. The agitation is required in order to maximize interaction between the wash solution and the packed RBC's. The IBM 2991 is effective in washing but the apparatus is complex and thus expensive and the procedure very time comsuming. (See: *Use and Analysis of Saline Washed Red Blood Cells* Wooten, M. J., Transfusion 16(5):464 1976)

Accordingly, it would be desirable to provide washing apparatus and methods which are simple, inexpensive and speedy.

DESCRIPTION OF THE INVENTION

In the method and apparatus of the present invention, packed RBC's are washed by a suitable wash solution within a centrifugal processing bag. The efficiency of the cell washing procedure is optimized by initially orienting the processing bag with respect to the axis of the centrifuge center of rotation (CR), such that (1) the highest density component, i.e., washed RBC's, accumulate at a corner of the bag *furthest* from the axis of the CR and locating the inlet port for the wash solution at that corner and (2) the lowest density component i.e., supernatant accumulates at a corner of the bag which is *closest* to the axis of the CR and locating the outlet port at this latter corner. This orientation is accomplished by means of a "double angled" cassette support which forces the processing bag to assume a position in the centrifuge rotor which is at an angle with respect to the axis of rotation and also at an angle with respect to the position of concentricity; hence the term "double angled".

The cassette support member is tilted inwardly from the vertical plane and the cylindrical segment shape of the member is off-set to be eccentric with the axis of the CR. The whole blood bag may be rectangularly shaped with four corners labelled A, B, C and D, counterclockwise from the upper right-hand corner "A" (looking from the CR). The bag is positioned adjacent the double angle support member. The tilted eccentric shape of the support member forces the bag to assume an orientation with respect to the axis of the CR such that:

$$r_1 < r_2 < r_4$$

and $r_1 < r_3 < r_4$ wherein $r_1$, $r_2$, $r_4$ and $r_3$ are the radii from respective bag corners A, B, C and D to the axis of the CR.

The supernatant outlet port is located at the shortest radius $r_1$, in this case, the upper right-hand corner "A", and the wash solution input port is located at the longest radius $r_4$, in this case, the lower left-hand corner "C". With the outlet port at the shortest radius, the lower density supernatant component can be readily removed through this port. Furthermore, by introducing the wash solution at the longest radius port location the wash solution interacts with or "sees" the most packed RBC's. Also, a turbulent flow is created whereby the cells are agitated thereby maximizing the cell washing efficiency.

These and other advantages will become apparent from the following description of the best mode for carrying out the invention.

BEST MODE FOR CARRYING OUT THE INVENTION GERNERAL PROCEDURE

Figure 1:
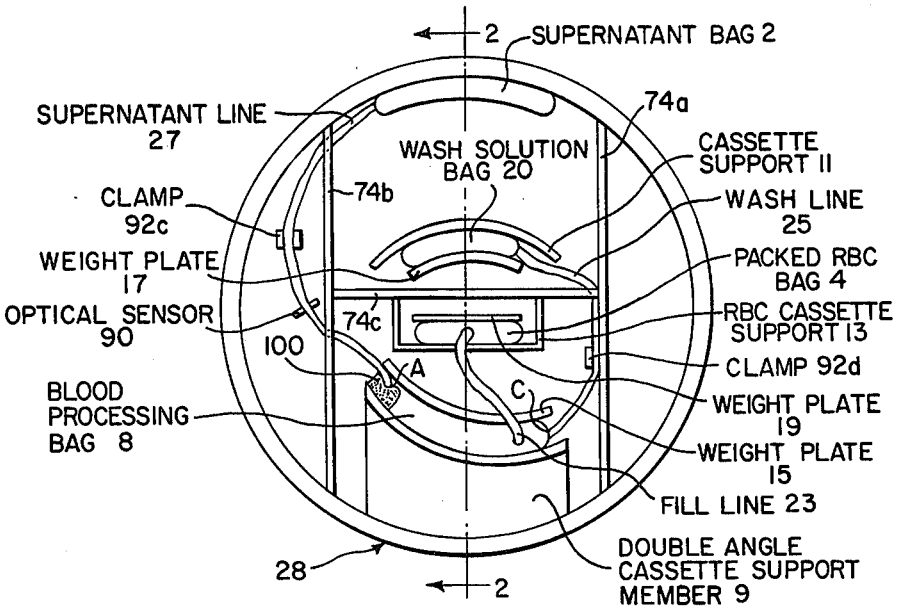
FIG. 1 is a simplified top view of an embodiment of the invention.

In general, it may be seen that this invention comprises an apparatus and process for washing blood components, particularly packed RBC's, with a suitable wash solution, such as a saline solution. The invention is not, however, intended to be limited to cell washing and may find applicability in other areas, such as plasmapheresis or plateletpheresis.

The invention will be described in connection with a specific centrifuge apparatus found in certain copending applications. Because of the imbalances produced in the processes to be described, it is desirable that a Self-Balancing Centrifuge as described in U.S. patent application Ser. No. 281,648 filed 9 Jul. 1981 now U.S. Pat. No. 4.412,831, (hereby incorporated by reference), or equivalent, will supply the necessary centrifugal force for blood processing in accordance with the invention. However, the invention is not intended to be limited to any particular centrifuge.

Furthermore, the invention will be described in connection with a copending U.S. patent application Ser. No. 281,655 filed 9 July 1981 (hereby incorporated by reference), which describes a new and improved pheresis process and apparatus generally constructed as follows. A first container, in the form of a flexible bag containing anticoagulated whole blood to be centrifugally separated, is supported by a cassette located on a centrifuge rotor. The cassette is in the form of a rack or stand partitioned into three annular sections by two vertically positioned support members. Each member has a shape generally described by a segment of a cylinder with a radius of curvature corresponding to a radius to the axis of the center of rotation (CR) of the centrifuge rotor. A second container is disposed in the cassette adjacent the first container and in fluid communication with the first container. The second container, which may also be a flexible bag, is adapted to receive one or more of the centrifugally separated components of the anticoagulated whole blood.

A pressure plate in the form of a body of material such as a metal plate also having a curvature corresponding to a radius to the axis of the centrifuge CR, and having a predetermined mass is disposed between the first bag and the center of rotation of the rotor. This pressure plate is suspended so that it is free to move radially against the first bag when subjected to the centrifugal forces generated by rotation of the centrifuge. The pressure plate has a predetermined mass sufficient to at least initiate a flow of separated fluid component from the first bag to the second bag as the pressure plate presses against the first bag during rotation of the centrifuge rotor. The mass distribution and shape of the pressure plate is adapted to pool the separated first blood component in the area of an umbilical fitment on the bag. An output port is located at this fitment.

The first bag and second bag are located adjacent each other on the rotor with the first bag positioned radially inward from the second bag. A siphon effect is created when flow is initiated from the first bag to the second bag as the pressure plate pushes against the first bag under the influence of centrifugal force. The siphon effect is due to the difference in centrifugal forces to which the bags are subjected because one bag is located nearer the center of rotation than the other.

As will subsequently be described, the combination of the pressure plate flow initiation and siphon effect described in the above referenced U.S. patent application Ser. No. 281,655 will be used in the present application in connection with a cell washing procedure and is therefore hereby incorporated by reference.

Figure 2:
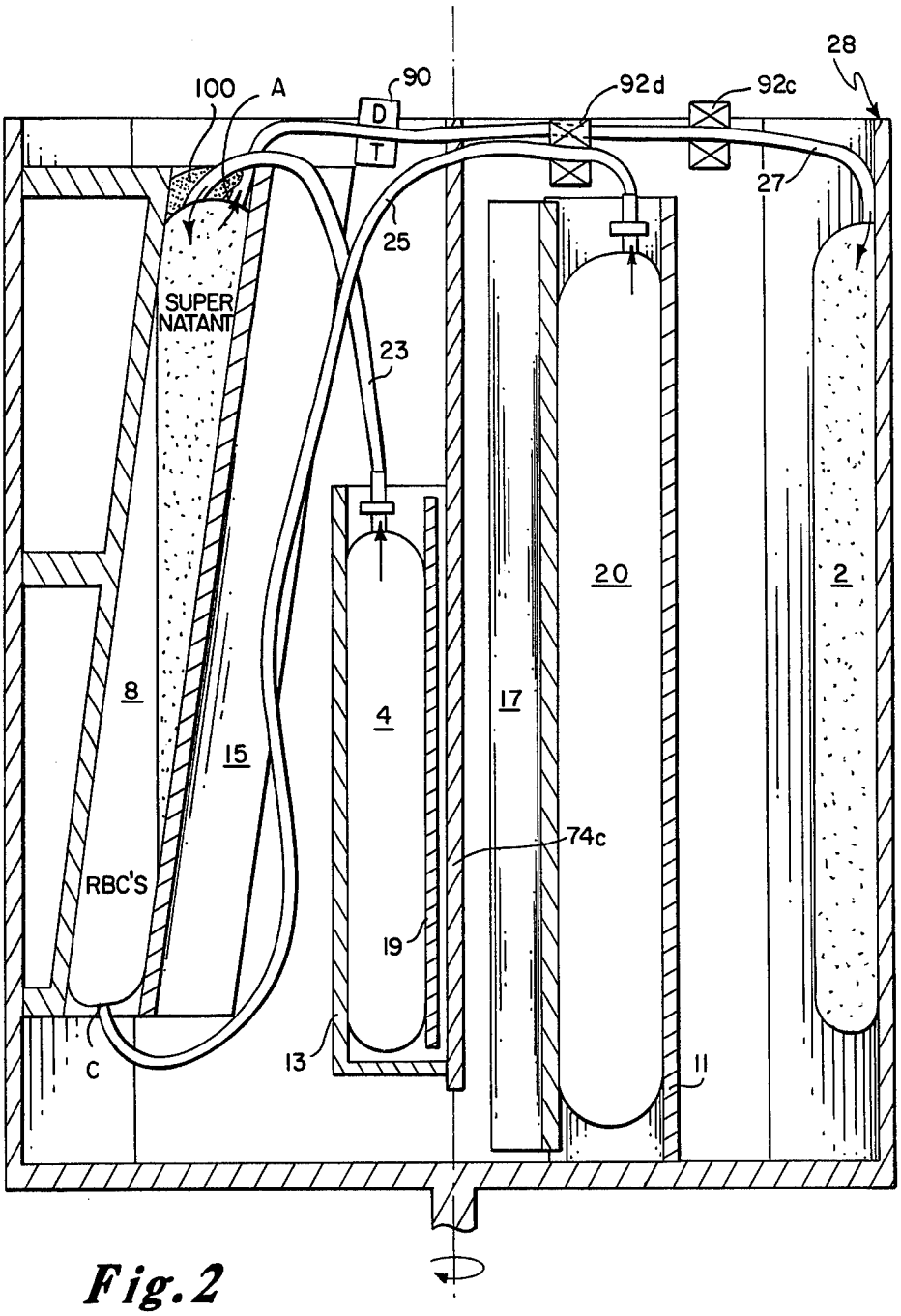
FIG. 2 is a cross-sectional view through lines 2—2 of FIG. 1.

Referring now to the apparatus of FIGS. 1 and 2, a double-angle cassette support member 9 (to be described in detail in connection with FIGS. 6 and 7) is located on one side of a centrifuge rotor 28 near the periphery. A weight plate 15 is located adjacent the cassette support member 9 and is free to move radially under the influence of centrifugal force toward the support member 9. A processing bag 8 is disposed between the weight plate 15 and the support member 9 and is oriented by support member 9 in a position such that lighter density component accumulates at the upper right-hand corner "A" of the bag 8 and heavier density component accumulates at the lower left-hand corner "C" of the bag 8. A deformable support member 100 is provided at corner "A" to insure that the outlet at port "A" is located sufficiently near the axis of the CR to enable all of the lighter density component (supernatant) to exit the port located at corner "A".

The blood processing/cell washing bag 8 is in fluid communication with (1) the wash solution bag 20 via wash line 25, (2) a supernatant bag 2 via supernatant line 27, and (3) a packed RBC's bag 4 via fill line 23. Line 27 is coupled through a solenoid actuated clamp 92*c*. Wash line 25 is coupled through a second solenoid actuated clamp 92*d*. Each of these clamps are supported on vertical support members 74*a* and 74*b*, which along with vertical support member 74*c* form an H-shaped vertical support structure to which various fixed components of the cell washing process may be attached. Supernatant bag 2 is disposed at the periphery of the centrifuge rotor opposite the double-angled cassette support member 9. Wash solution bag 20 is located between a cassette support 11 and a weight plate 17 at a location nearer the axis of the CR of the rotor than the blood processing-/cell washing bag 8, but on the opposite side of the axis of the CR from bag 8. The packed RBC's bag 4 is located between a RBC cassette support 13 and a weight plate 19 at a location nearer the axis of the CR of the rotor than the blood processing bag 8 and on the same side of the CR as bag 8.

Before cell washing; anticoagulated whole blood is centrifugally separated in whole blood bag 4 in a swinging bucket centrifuge (not shown). The plasma is then manually expressed leaving behind packed RBC's in bag 4.

To wash the packed RBC's, the bag 4 is placed in the RBC cassette between the support 13 and the weight plate 19. The packed RBC's bag 4 is connected by bag spike 43*a* (See FIG. 3) and conduit 23 to processing bag 8. Processing bag 8 30 is placed between the double angle cassette 9 and weight plate 15. Similarly, the wash solution bag 20 is attached to the processing bag 8 with bag spike 43*b* (See FIG. 3) and placed between cassette support 11 and weight plate 17. All of the weight plates and supports, with the exception of the support member 9 and weight plate 15, are similar to those described in the previously referenced application, Ser. No. 281,655.

Figure 5:
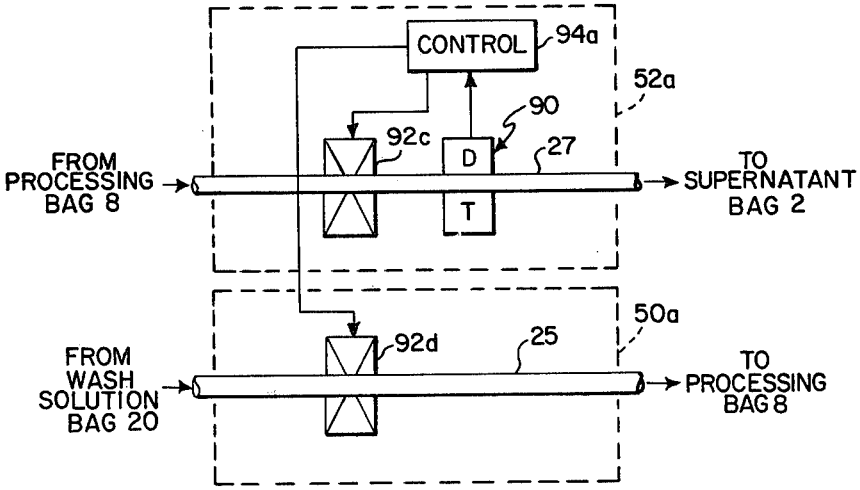
FIG. 5 is a schematic illustration of the controls for cell washing.
Figure 3:
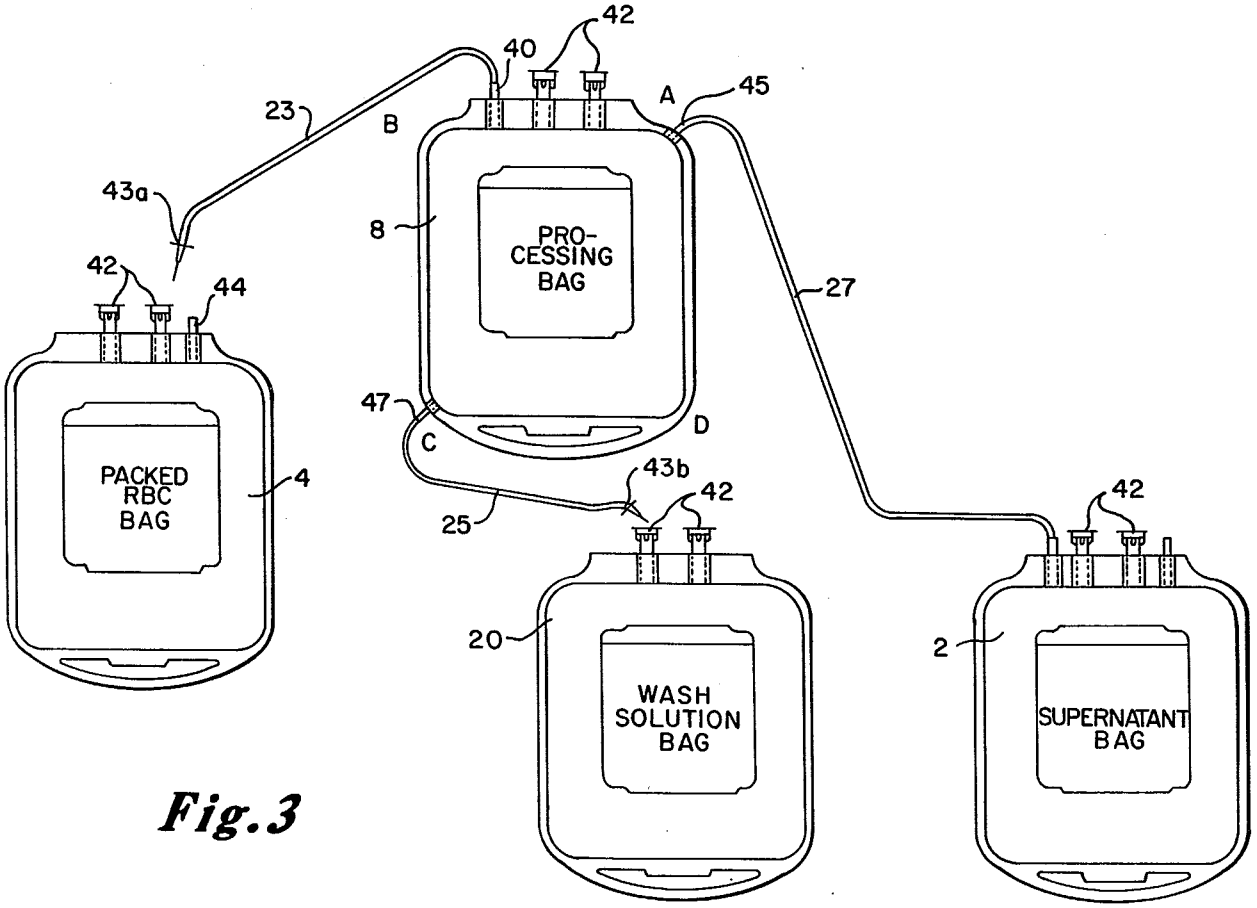
FIG. 3 is a plan view of a disposable software set utilized in an embodiment of the invention.

The conduit from supernatant bag 2 is labelled 27 in FIG. 3, and as seen in FIGS. 1, 2 and 5 is disposed between optical sensor 90 and solenoid actuator clamp 92*c*. Similarly, the conduit 25 between the port 47 and the wash solution bag 20 is disposed between a solenoid actuated clamp 92*d*. The control circuitry for the clamps 92*c* and 92*d* is shown in FIG. 5.

Having made these connections, the apparatus is now ready for a cell washing procedure. The centrifuge is rotated, causing pressure plate 19 to press against packed RBC's bag 4 expressing the contents into the processing bag 8. At this point in time, conduit 27 has been clamped off by clamp 92*c*. Furthermore, initially, conduit 25 is clamped until sufficient dwell time is achieved to insure that the RBC's have accumulated at port 47. After this dwell time has elapsed, the clamp 92*d* on conduit 25 is opened, the wash solution is expressed into the processing bag 8, now containing packed RBC's. This is accomplished while the centrifuge is spinning and cell washing takes place, as shown generally in FIG. 4.

After a sufficient period of centrifugation has occurred, the washed RBC's will accumulate at the lower left-hand corner "C" of the processing bag 8, and supernatant will accumulate at the upper right-hand corner "A".

Next, the conduit 27 connected to port 45 of the processing bag is unclamped by operation of clamp 92*c* to permit passage of supernatant from processing bag 8 to supernatant bag 2. A siphon effect is created when flow is initiated from the processing bag 8 to the supernatant bag 2 as the pressure plate 15 pushes against the processing bag under the influence of centrifugal force. The siphon effect is due to the difference in centrifugal forces to which the bags are subjected because one bag is located nearer the center of rotation than the other.

Optical sensor 90 senses when red blood cells pass through conduit 27 whereupon it provides a signal to control 94*a* which energizes clamp 92*c* to clamp conduit 27 and prevents further flow from the processing bag 8.

The procedure of expressing saline into the processing bag 8 through conduit 25 and removing supernatant from processing bag 8 through conduit 27 may be repeated several times to assure an optimal removal of plasma, platelets, white blood cells and cell debris from the packed RBC's.

After the wash procedure is completed, the centrifuge can be stopped, and the conduit 27 to the supernatant bag 2 may be manually clamped and severed from the processing bag which now contains the washed RBC's. Likewise, the packed RBC's bag 4 and the wash bag 20 may be severed from the processing bag 8 and the RBC's, which have now been centrifugally washed, may be reintroduced to a patient.

Double Angled Support Member

The construction of the processing bag 8 and its corresponding back support member 9 is unique to this invention and will be described in some detail in connection with FIGS. 6–8.

Figure 6:
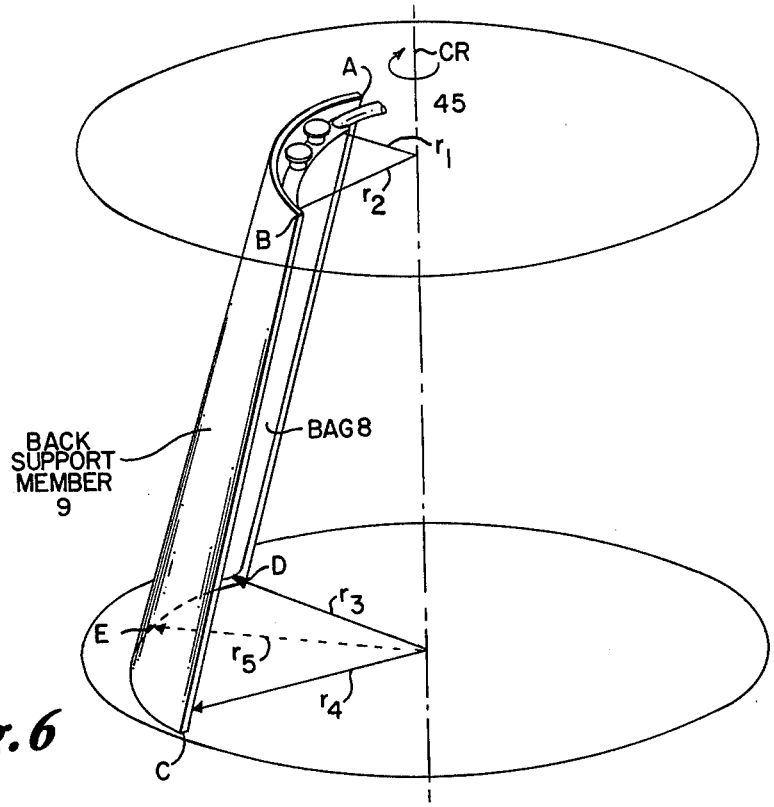
FIG. 6 is a schematic representation of the back support member 9 and bag 8 of the invention.
Figure 7:
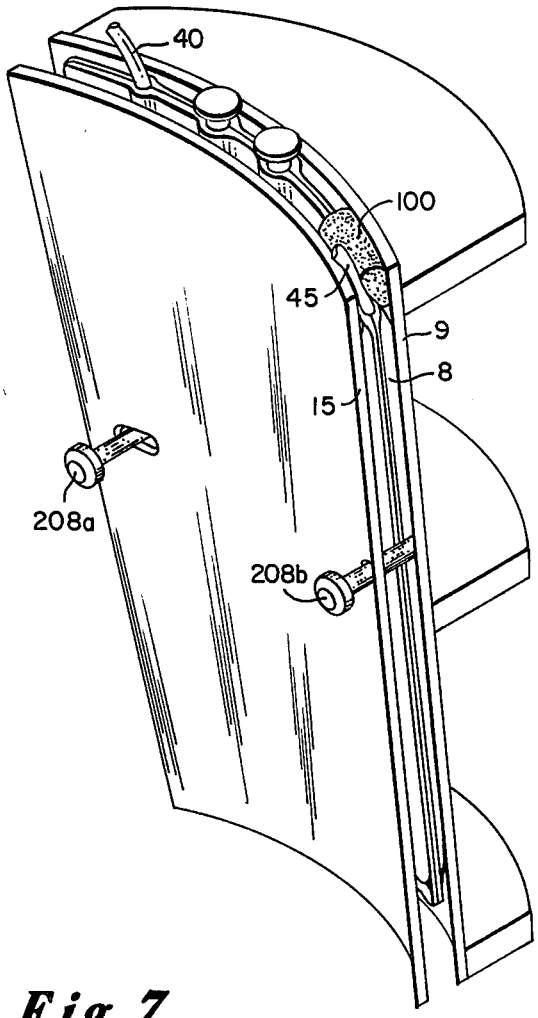
FIG. 7 is a perspective view of the double-angle back support member.

In the method and apparatus of the present invention, as shown in FIG. 6, the processing bag 8 is oriented by a rigid back support member 9, such that (1) the highest density component (RBC's) accumulate at the lower left-hand corner of the bag furthest from the axis of the center of rotation (CR) of the centrifuge and where the inlet port 47 is located and (2) the lowest density component (supernatant) and wash solution accumulate at the upper right-hand corner of the bag which is closest to the axis of the CR of the centrifuge and where the outlet port 45 is located, as shown in FIG. 7. This is accomplished by utilizing a "double angled" cassette support member 9, shown in FIG. 7, which orients the processing bag in the centrifuge rotor at an angle with respect to the axis of rotation and also at an angle with respect to the position of concentricity; hence the term "double angled". To do this, the cassette support member 9 is tilted inwardly from the vertical plane and the cylindrical segment shape of the member 9 is formed eccentric with the axis of the CR. The degree of tilt is preferably sufficient to provide a maximum separation gradient consistent with the permissable space provided in the centrifuge rotor. Likewise, the degree of eccentricity of the support member is predicted on achieving good separation within the limitations of space.

The pressure plate (15 in FIG. 7) is a body of material such as a metal or plastic plate having a curvature generally corresponding to the curvature of the support member 9 and having a predetermined mass. The plate is disposed between the processing bag and the axis of the CR of the rotor. This pressure plate 9 is suspended so that it is free to move radially against the processing bag 8 when subjected to the centrifugal forces generated by rotation of the centrifuge. The pressure plate 9 has a predetermined mass sufficient to at least initiate a flow of separated fluid component from the processing bag 8 to the supernatant bag 2 as the pressure plate 9 presses against the processing bag 8 during rotation of the centrifuge rotor. The mass distribution and shape of the pressure plate 9 is adapted to pool the separated component in the area of the outlet port 45.

Figure 4:
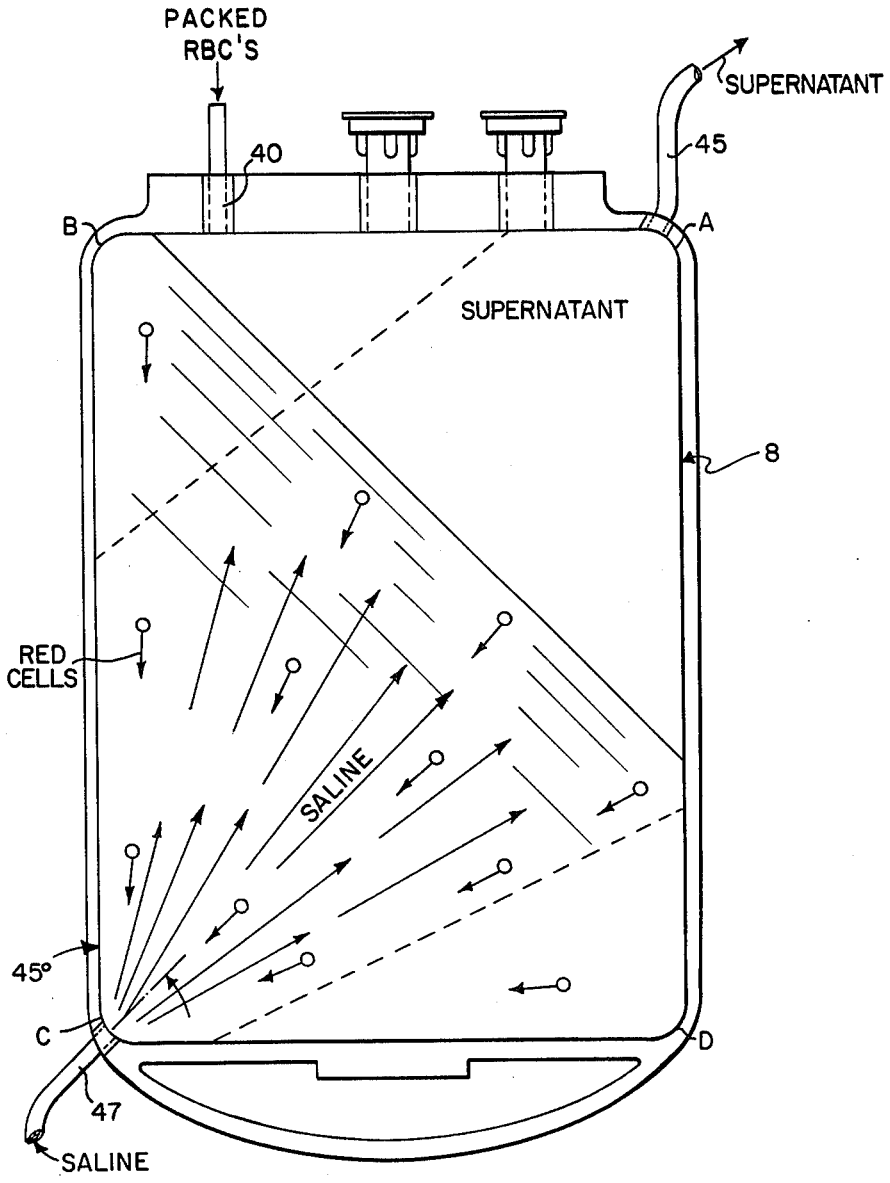
FIG. 4 is an enlarged plan view of the bag structure illustrating further details of the invention.

Bag 8 is rectangular in shape (as can be seen more clearly in FIG. 4 with four corners A, B, C, and D, lettered counterclockwise from the upper right-hand corner. Preferably, the bag is manufactured from two sheets of PVC welded together at the edges. In order to utilize inexpensive materials in the fabrication of such bags and yet withstand the pressures generated during separation, it may be desirable to utilize a support structure for each bag as described in copending U.S. patent application Ser. No. 339,910filed 18 Jan. 1982.

When the bag is positioned in the support member 9, the tilted eccentric shape of the support member forces the bag to assume an orientation, with respect to the axis of the CR (See FIG. 6) such that $$r_1 < r_2 < r_4$$

and $$r_1 < r_3 < r_4$$

wherein $r_1$, $r_2$, $r_4$ and $r_3$ are the radii from respective bag corners A, B, C and D to the axis of the CR.

The outlet port 45 to the supernatant bag 2 is located at the shortest radius $r_1$, in this case, the upper right-hand corner "A", and the wash solution input port 47 is located at the longest radius $r_4$, in this case the lower left-hand corner "C". With the outlet port at the shortest radius, the lower density component can be removed through this port. Furthermore, by introducing the wash solution at the longest radius port location, the solution "sees" the most packed RBC's and generates a counter-current flow through the red cells, thus maximizing cell washing efficiency.

Software Set

Referring now to FIG. 3, there is shown a software set suitable for use in connection with the present invention. The software set consists essentially of two fluid interconnected flexible bags 2 and 8, plus two accessory bags 4 and 20. Bags 4 and 20 are not initially interconnected with the other bags but bag 8 is equipped with conduits 23 and 25, respectively, at the end of which bag spikes 43*b* and 43*a* are provided to enable fluid communication with ports 42 on each bag for cell washing.

Bag 4 contains packed RBC's which are expressed into processing bag 8 via port 40 for cell washing with a wash solution from bag 20. The wash solution is expressed into corner port 47 from bag 20 via conduit 25. Supernatant from the wash procedure is expressed from bag 8 via outlet corner port 45 and conduit 27 to supernatant bag 2.

As previously noted in connection with bag 8, these bags are preferably made of suitable thin walled hemocompatible plastic material, such as polyvinyl chloride (PVC). The basic construction of these bags consists of forming two sheets of material in accordance with the desired bag shape and welding the edges of the sheets together to form an interior chamber for the bag.

As may be seen clearly in FIG. 4, using the "double angle" orientation for cell washing allows the introduction of the saline at the location where it can "see" the most red cells. The more dense red cells pack at the outer-most radius, corner "C" in FIG. 4. Introducing saline from a port 47 in that corner directs the saline through the bed of packed cells. A counter-current flow is generated by centrifugal forces without the necessity for a separate agitation cycle. The less dense saline moves from corner "C" to corner "A", while the red cells move in the opposite direction right back into the stream of saline at corner "C". The saline carries other less dense components (supernatant) such as platelets, white blood cells and plasma proteins with it leaving only washed red cells in corner "C". The supernatant, including the platelets, white blood cells and plasma proteins can then be expressed through port 45 at corner "A".

Several details about the construction of processing bag 8 are important. The wash inlet port 47 should be small enough in diameter to provide a turbulent jet to promote mixing of the wash solution and RBC's. A 1/16 inch diameter inlet port with a 300 ml/minute saline wash solution flow rate provides acceptable results. In addition, we have found that the inlet port 47 at "C" works best if it is disposed at an angle of from 30° to 90° with respect to the side of the bag. This directs the saline into the center of where the RBC's have packed. It may also be desirable to create a more diagonal shaped bag as indicated by the dashed lines in FIG. 4. This would prevent packing in corners "B" and "D" where the wash solution jet may not reach the cells.

We have found through tests using a self-balancing centrifuge, as described in U.S. patent application Ser. No. 281,648, and a double-angled blood processing bag, as described herein, that the geometry of the bag is critical to the effective expression of wash solution and plasma (low-density component) from red blood cells (high-density component). In particular, the radius (measured from the axis of rotation to the processing bag) should consistently decrease from (See FIG. 6):

C to A : ($r_4$ to $r_1$)
C to D : ($r_4$ to $r_3$)
C to B : ($r_4$ to $r_2$)
D to A : ($r_3$ to $r_1$)
B to A : ($r_2$ to $r_1$)

If the radius does not consistently decrease, the higher density component will pack in the area of increasing radius. For example, referring to FIG. 6, in an experiment with blood, the radius $r_4$ at "C" was 5.1 inches, the radius $r_3$ at "d" was 5.1 inches and the radius $r_5$ at "E" was 5.5 inches. Consequently, the red blood cells accumulated at "E" instead of "C" where they were desired. By changing the radius $r_4$ to be 5.1 inches at "C", $r_5$ to 4.9 inches at "E" and $r_3$ to 4.6 inches at "D", the red blood cells accumulated at "C".

Note that an *increasing* radius may be desirable for certain applications. For example, if it were desired to retain some plasma with packed red cells to lower the hematocrit, a pocket of plasma could be retained by first increasing the radius from the bottom of the bag (C and D) to midway up the bag and then decreasing the radius from the midpoint to the top of the bag (A and B).

Figure 8A:
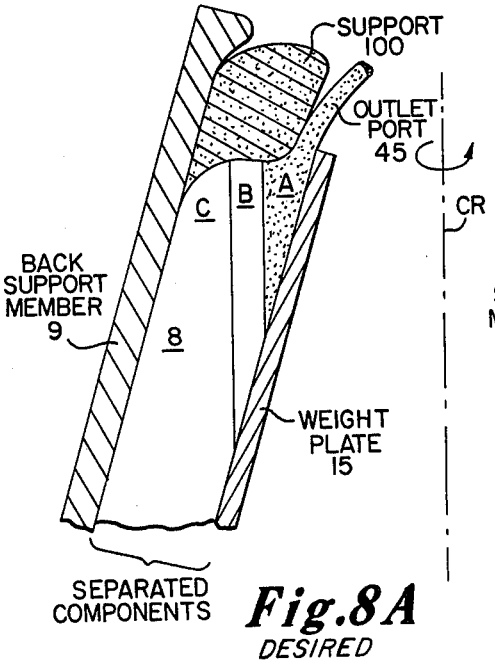
FIGS. 8A and 8B are a diagramatic sectional illustration of the details of the invention with a support 100 (FIG. 8A) and without a support (FIG. 8B).
Figure 8B:
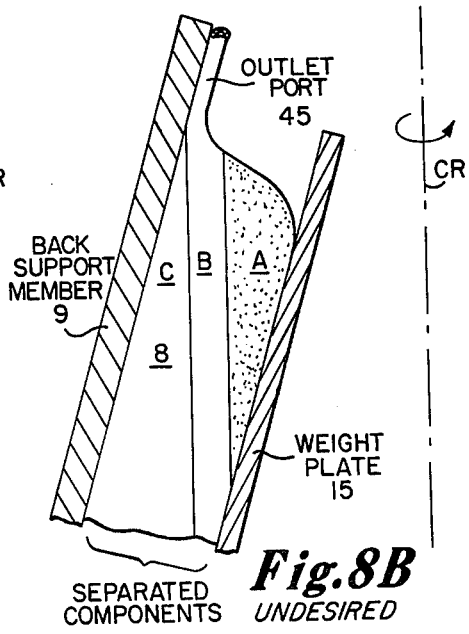

We have also found that the position of the outlet port 45 at "A" with respect to the weight plate 15 and the back support member 9, is critical for complete removal of the desired component. The outlet port 45 must be positioned at an innermost radius as shown in FIG. 8A. If the port is allowed to fall back to the back support member due to the centrifugal force, some components may be trapped at an inner radius, as happened to component A in FIG. 8B. The outlet port may be held directly to the weight plate 15 with clips, or a deformable support member 100 may be used to position the outlet port 45 against the weight plate. This deformable support member 100 may be a spring mechanism or (as shown) may be shaped from a deformable material such as foam rubber.

A measure of the effectiveness of a wash procedure with respect to the removal of plasma proteins is the fraction of free hemoglobin removed as a function of the amount of wash solution used. The hemoglobin content of the fluid surrounding the RBC's is easily measured. Determining the hemoglobin content before and after a wash procedure provides a quantitative measure of the fraction of plasma proteins removed.

Our tests have shown that by repeating the wash cycle from 4 to 6 times, 97% of the plasma in the packed RBC's is removed (as measured by reduction of hemoglobin concentration). This procedure requires about 400 ml of wash solution and takes approximately 12 minutes. Comparatively, the IBM 2991 cell washing system removes 99.4% of the plasma [as measured by total protein) and consumes 1000 ml of saline (M. J. O'Connor Wooten, Transfusion 16(5): 464–468 (1976)]and takes about 27 minutes (H. T. Meryman, et al., Transfusion 20(3): 285–292 (1980).

Equivalents

Those skilled in the art may recognize other equivalents to the specific embodiments described herein, which equivalents are intended to be encompassed by the claims attached hereto.

For example, instead of cell washing, the processing bag 8 may be used purely for pheresis (component separation) in which case, anticoagulated whole blood may be introduced at the lower corner "C" (port 47) and centrifugally separated into packed RBC's and plasma. After separation, the plasma would be expressed out corner "A" (port 45) in the manner previously described.

Also, the apparatus may be used for deglycerolization of frozen RBC's in glycerol. The frozen product is thawed and introduced into bag 8 at corner "B" (port 40) and processed as previously described until the glycerol is removed with the supernatant.

Furthermore, while the support member 9 and pressure plate 15 may be described in general as segments of a cylinder, they need not be cylindrically shaped but can be asymetric in shape to provide pooling of components at desired locations.

We claim:

1. Blood processing apparatus for separation of blood components by centrifugation in a centrifuge rotor comprising: a first flexible bag and support means for orienting said first flexible bag with respect to the center of rotation of said rotor to cause, upon rotation of said rotor, lighter density components to accumulate at a first location within said bag and heavier components to accumulate at a second location diagonally opposite said first location and wherein ports are located at said first and second locations; an input port located at the second location and wherein said support means has a vertically extending wall with a curved surface tilted inwardly toward and eccentric to the axis of the center of rotation.

2. The apparatus of claim 1 in which the input port is of a predetermined size so that as fluid flows through the input port into the first flexible bag, a turbulent fluid stream is generated.

3. The apparatus of claim 2 in which the input port is directed towards the center of the accumulated heavier density component.

4. Apparatus for processing fluids in a centrifugal force field to separate constituent components of such fluids comprising in combination:

(a) a centrifuge having a rotor adapted to rotate at a sufficient speed to cause said components to separate;

(b) a first flexible bag mounted on the rotor and adapted to contain a first fluid;

(c) a receiver container mounted on the rotor and adapted to receive at least one component of said first fluid;

(d) a first conduit means for coupling the flexible bag and the receiver container in fluid communication;

(e) a first mass means disposed nearer the center of rotation of the rotor than the flexible bag and adapted to move against a surface of said bag, said mass being sufficient to at least initiate a flow from said bag to said container through said conduit means of component fluid separated in said bag;

(f) a first support means for orienting the flexible bag in the rotor such that an output port on said flexible bag is located nearer the axis of the center of rotation of the centrifuge rotor than an input port on said flexible bag whereby during centrifugation, the less dense components will accumulate at the output port and the more dense components at the input port.

5. The apparatus of claim 4 wherein the flexible bag is generally planar in shape and the output port is located at a corner "A" and the input port at a diagonally opposite corner "C".

6. The apparatus pf claim 5 wherein the bag corner laterally adjacent "A" is "B" and the bag corner vertically adjacent "A" is "D"

and $r_1 < r_2 < r_4$ and $r_1 < r_3 < r_4$ wherein $r_1$, $r_2$, $r_4$ and $r_3$ are the radii from respective bag corners A, B, C and D to the axis of the center of rotation of the centrifuge.

7. The apparatus of claim 4 wherein the support means is a curved member which is vertically tilted inward toward the axis of the center of rotation of the centrifuge and the member is off-set to be eccentric to the axis of the center of rotation of the centrifuge.

8. The apparatus of claim 4 in which the radial distance from any point on the periphery of the bag to the axis of the center of rotation decreases from the input port to the output port in either direction about the bag periphery.

9. The apparatus of claim 4 in which the more dense component is RBC's and the input port is coupled to a wash solution and the diameter of the input port is small enough to cause the input flow to be turbulent.

10. The apparatus of claim 9 wherein the wash solution is contained in a second flexible bag connected via a second conduit means to the input port, said wash solution bag being disposed between a second mass and a second support nearer the center of rotation than the first flexible bag, said second mass being sufficient to at least initiate flow from said second flexible bag to said first flexible bag.

11. The apparatus of claim 10 wherein a third flexible bag of RBC's is disposed nearer the center of rotation in the rotor than the first flexible bag, said third flexible bag is interposed between a third mass means and a third support means, said third mass means being sufficient to at least initiate flow from said third flexible bag to said first flexible bag via a third conduit means between said first and third flexible bags.

12. The apparatus of claim 4 including port locating means for positioning the output port nearer the axis of the center of rotation than the accumulated more dense component.

13. The apparatus of claim 12 wherein the input port is directed at the center of the accumulated more dense component.

14. The apparatus of claim 13 wherein the input port as directed at an angle of 30°–90° with respect to the side of the bag.

15. Apparatus for processing fluids in a centrifugal force field to separate constituent components of such fluids comprising in combination:

(a) a centrifuge having a rotor adapted to rotate at a sufficient speed to cause said components to separate;

(b) a plurality of flexible bags in fluid communication with each other adapted to contain a fluid component;

(c) each of said bags being disposed in spaces provided between vertically extending walls of a cassette mounted in said rotor;

(d) a plurality of mass means, each suspended on one of said walls and adapted to move against a surface of an adjacent bag, said mass being sufficient to at least initiate a flow of component fluid separated in said bag from said adjacent bag to another bag located further away from the center of the rotor;

(e) one of said vertically extending walls having a curved surface tilted inwardly toward and eccentric to the axis of the center of rotation of the centrifuge rotor.

16. The apparatus of claim 15 in which one of the bags nearest the center of rotation is adapted to contain wash solution and the other is adapted to contain RBC's, and the next nearest bag is adapted to receive RBC's and wash solution, and the outermost bag is adapted to receive a less dense component of said RBC's and wash solution.

17. The apparatus of claim 16 wherein the bag adapted to received RBC's and wash solution is positioned between the tilted eccentric wall and a suspended mass means.

18. The apparatus of claim 17 wherein the bag adapted to receive RBC's and wash solution has an outlet port at one corner coupled to an inlet port of said outermost bag and an inlet port at a diagonally opposite corner coupled to an outlet port of said bag adapted to contain wash solution.

19. The apparatus of claim 18 wherein the bag adapted to receive RBC's and saline wash solution has an inlet port lateral to the outlet port coupled to an outlet port in said bag adapted to contain RBC's.

20. A method comprising:

(a) orienting a flexible bag in a centrifuge against a curved surface support such that when a volume of fluid contained in said flexible bag is rotated in a centrifuge at a speed sufficient to separate said fluid into a less dense and more dense component, the less dense component accumulates at a first port on said bag and the more dense component at a second port on said bag;

(b) forcing the less dense component to flow from said flexible bag to a container by applying centrifugal force to a moveable body against a planar surface of said bag while said volume is being rotated;

(c) preventing the flow in step (b) until substantial separation occurs in setp (a) and;

(d) causing the flow to stop when the less dense component has passed from the first bag to the second bag.

21. The method of steps claim 20 wherein (b)–(d) are repeated until sufficient removal of less dense component from more dense component is achieved.

22. The method of claim 21 wherein the more dense component is RBC's and the less dense component is a supernetant consisting of plasma, platelets, white cells, and wash solution.

23. The method of claim 20 in which after the flow is stopped in step (d) the more dense component is washed by a washing solution introduced at the second port.

24. The method of claim 20 in which the size of the second port is such as to cause the washing solution to create turbulence in the dense component stream.

25. The method of claim 20 wherein a less dense washing solution is directed through the accumulated more dense component creating a counter-current flow situation.

26. The method of claim 20 which the flow is stopped in step (d) by a sensor responsive to optical change as different fluid components pass the sensor.

27. In a process wherein blood is separated into a first blood component and second blood component in a blood processing chamber mounted on a centrifuge rotor and first blood component is thereafter caused to flow through an outlet port of said chamber through a conduit and into a receiver container:

The improvement of causing said less dense and more dense components to accumulate at diagonally opposite inlet and outlet ports on said chamber by orienting the chamber with respect to the axis of the center of rotation of the centrifuge.

28. The improvement of claim 27 in which the chamber comprises a generally planar flexible bag and supernatant accumulates at a corner of said bag nearest the axis of the center of rotation while RBC's accumulate at a corner of said bag furthest from said axis.

29. The improvement of claim 28 in which the RBC's are washed by a washing solution.

30. The improvement of claim 29 in which the supernatant resulting from washing the RBC's is expressed to a receptacle mounted on said rotor.

31. Blood processing apparatus for seperation of blood components by centrifugation comprising:

(a) a first flexible bag wherein lighter density components accumulate at a first location within said bag and heavier components accumulate at a second location diagonally opposite said first location and wherein ports are located at said first and second location;

(b) a first fluid conduit fixedly connected to the second location at a lower corner of the first bag, said conduit having a bag spike on one end thereof; and (c) a second bag coupled by a second fluid conduit to said first location at a corner diagonally opposite the lower corner.

* * * * *